US006186076B1

(12) United States Patent
Sung

(10) Patent No.: US 6,186,076 B1
(45) Date of Patent: Feb. 13, 2001

(54) PARTITION COMBINED TO COMPUTER DESK TO DISPLAY SCREEN OF MONITOR

(76) Inventor: Chang-Nam Sung, 2Fl., 73-7, Sungnam-Dong, Jungwon-Ku, Sungnam-Si, Kyunggi-Do (KR)

( * ) Notice: Under 35 U.S.C. 154(b), the term of this patent shall be extended for 0 days.

(21) Appl. No.: 09/221,581

(22) Filed: Dec. 29, 1998

(30) Foreign Application Priority Data

Jan. 10, 1998 (KR) ..... 98-442

(51) Int. Cl.[7] ..... A47B 37/02

(52) U.S. Cl. ..... 108/50.02; 312/196; 312/223.2; 108/50.01

(58) Field of Search ..... 312/323.3, 194, 312/196, 223.5, 236, 237; 454/184, 49; 353/74, 77, 78, 79; 108/50.01, 50.02

(56) References Cited

U.S. PATENT DOCUMENTS 2,734,441 * 2/1956 Williams ..... 454/184
2,734,990 * 2/1956 Leuschner ..... 312/194
4,766,422 * 8/1988 Wolters et al. ..... 312/194
5,368,377 * 11/1994 Baines ..... 312/194
5,480,224 * 1/1996 Ugalde ..... 312/194
5,651,594 * 7/1997 Lechman ..... 312/194
5,957,059 * 9/1999 Burhman ..... 312/194

FOREIGN PATENT DOCUMENTS

WO 92/06616 * 4/1992 (WO) ..... 312/194

* cited by examiner

*Primary Examiner*—Janet M. Wilkens
*Assistant Examiner*—Michael J. Fisher
(74) *Attorney, Agent, or Firm*—Arent Fox Kintner Plotkin & Kahn, PLLC

(57) ABSTRACT

An assembly that combines a partition and computer desk to display a screen of a monitor positioned beneath the computer desk. A keyboard box is slidable along a bottom face of an upper plate of the computer desk. A wire connected a limit switch attached to the keyboard box turns the monitor ON when the keyboard box is drawn out from underneath the upper plate. A user can see an image of the monitor screen through glass fixed to the upper plate and reflected by a mirror positioned in front of a reflection plate on the partition.

10 Claims, 6 Drawing Sheets

PARTITION COMBINED TO COMPUTER DESK TO DISPLAY SCREEN OF MONITOR

BACKGROUND OF THE INVENTION

1. Field of the Invention

The present invention relates to a partition combined with a computer desk to display a screen of a monitor. And, particularly, to a computer desk having a monitor box and a computer body box separately provided for respectively installing the monitor and the computer body. A desk where a groove and glass are installed with a keyboard box attached houses a monitor box and the computer body box. The upper plate of the desk has a motor, wire and mirror box attached to the inside of the partition. A reflection plate with the motor, wire, mirror, and cover is installed inside of the partition. Thereby, a user can see a screen of the monitor through the mirror by drawing the reflection plate to open the cover and reflecting the screen of the monitor through the mirror installed into a front of the reflection plate when using the computer. On the other hand, when not using the computer, the desk can be used for other purposes by inserting the reflection plate where the mirror is attached to the inside of the partition to have an original volume of the partition and an original width of the desk. Further, in the present invention, the partition can be used as an originally intended compartment device and provide such advantages as minimizing the user from any harmful electromagnetic waves generated.

2. Discussion of Related Art

A monitor and a computer body are provided on a desk, or, the monitor is provided on the desk and the computer body on the floor to provide more usable space on the upper plate of the desk. However, when both are placed on the desk, the monitor and computer body occupy considerably wide areas of space because of their relatively large volume.

Therefore, there exists a problem that the upper plate is too narrow to be used for the other purposes such as work.

Accordingly, computer users generally use a special computer desk, but, in this case, the users have to buy the special computer desk and prepare the additional space needed. There exists a problem in increasing the financial and spatial burden to the user.

To solve the problems mentioned above, conventionally, both monitor and computer body were installed to the inside of the desk and, the upper plate of the desk was covered with a glass to see the screen of the monitor through the glass.

However, when using the above-mentioned conventional computer desk, since the user had to see the screen while bowing his head, his eyes were easily fatigued and there was the probability of causing spinal column disease such as a strained neck disk.

At present, the size of monitors ranging from 14 inches to 18 inches are generally being used, and as the size of the monitor increases, fatigue of the user is reduced and therefore, the usage of the large monitor has increasingly popularized.

Meanwhile, an amount of the electromagnetic waves generated increases proportional to the size of the monitor. Nevertheless, the conventional computer desk does not have a device or method capable of preventing the user from the harmful electromagnetic waves.

That is, the monitor making an image of a high voltage and high frequency further generates very strong and harmful electromagnetic waves and rays that spread in all directions.

Accordingly, a user using such a computer all day long and individuals working near the user are all unconsciously affected by the harmful electromagnetic waves and rays, and thereby, their health is susceptible to various disease such as VDT symptom.

Presently, various studies on how to reduce the harmful electromagnetic waves are being conducted.

Meanwhile, the best current method for preventing the effect of the harmful electromagnetic waves is to switch on the monitor only when using the computer. But, this method may easily break the power switch of the computer.

The generally used computer system performs a power saving function when not being used in a predetermined time period, but, during this state, the monitor is continuously working and therefore, the harmful electromagnetic waves generated by the monitor continues to be transmitted to the users.

Further, partitions to be installed for distinguishing parts are used only as compartments, and not for other purposes, and accordingly, always occupies predetermined volume of workable space on the desk.

SUMMARY OF THE INVENTION

Accordingly, the present invention is directed to an apparatus and method for providing a partition combined with a computer desk to display a screen of a monitor that substantially obviates one or more of the problems of the related art.

An object of the present invention is to provide a computer desk that permits a user to see a screen of a monitor through a mirror by drawing out a reflection plate to open a cover. The screen of the monitor is reflected through the mirror installed into a front of the reflection plate. A monitor box and a computer body box are separately provided for respectively installing the monitor and the computer body. A desk having a groove where a glass is installed and a keyboard box are combined to the monitor box. A reflection plate formed of a motor, a wire, the mirror, and the cover is installed inside of the partition and are capable of being used for various purposes by inserting the reflection plate where the mirror is attached into the partition to have an original volume of the partition and an original width of the desk without the computer being used. The amount of harmful electromagnetic waves generated is minimized which prevents a user from the harmful waves. The partition can also be used as an originally intended compartment device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described include the following: a partition combined with a computer desk and monitor screen, one socket part of plural socket parts where plug parts connect a power supply to the monitor are inserted to connect the one plug part so that electricity from a power supply outlet can be supplied as positive current to a fan connected to a motor between the plug part and socket part of plural socket parts. A limit switch is attached by a wire to the side of a keyboard box connected to the other socket part. When the limit switch connected to the wire, which connects the other socket part to a fan and supplies a negative current, is turned ON, the current passing through the fan is transmitted to the monitor along the wire. When the limit switch is turned OFF, the current of the power supply outlet passing through the fan is cut off by the limit switch to turn off the monitor. An electromagnetic wave cut off film cuts off any electromagnetic waves emanating from the monitor with the help of a fan passing through the partition and installed at the end of the keyboard box. A motor within the partition is turned on and off when the keyboard box within the partition is drawn along the keyboard rail. A wire worked by the motor is connected to the reflection plate attached to the front of the mirror so that the reflection plate may move up and down along the reflection plate rail as the wire is unraveled and wound. A wire cap is formed in the center portion of the partition and, a positive plug and a negative plug are respectively installed to the right side and left side in the wire cap. Partitions are connected by connecting the plugs in the wire cap wherebetween the current is transmitted.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 7:
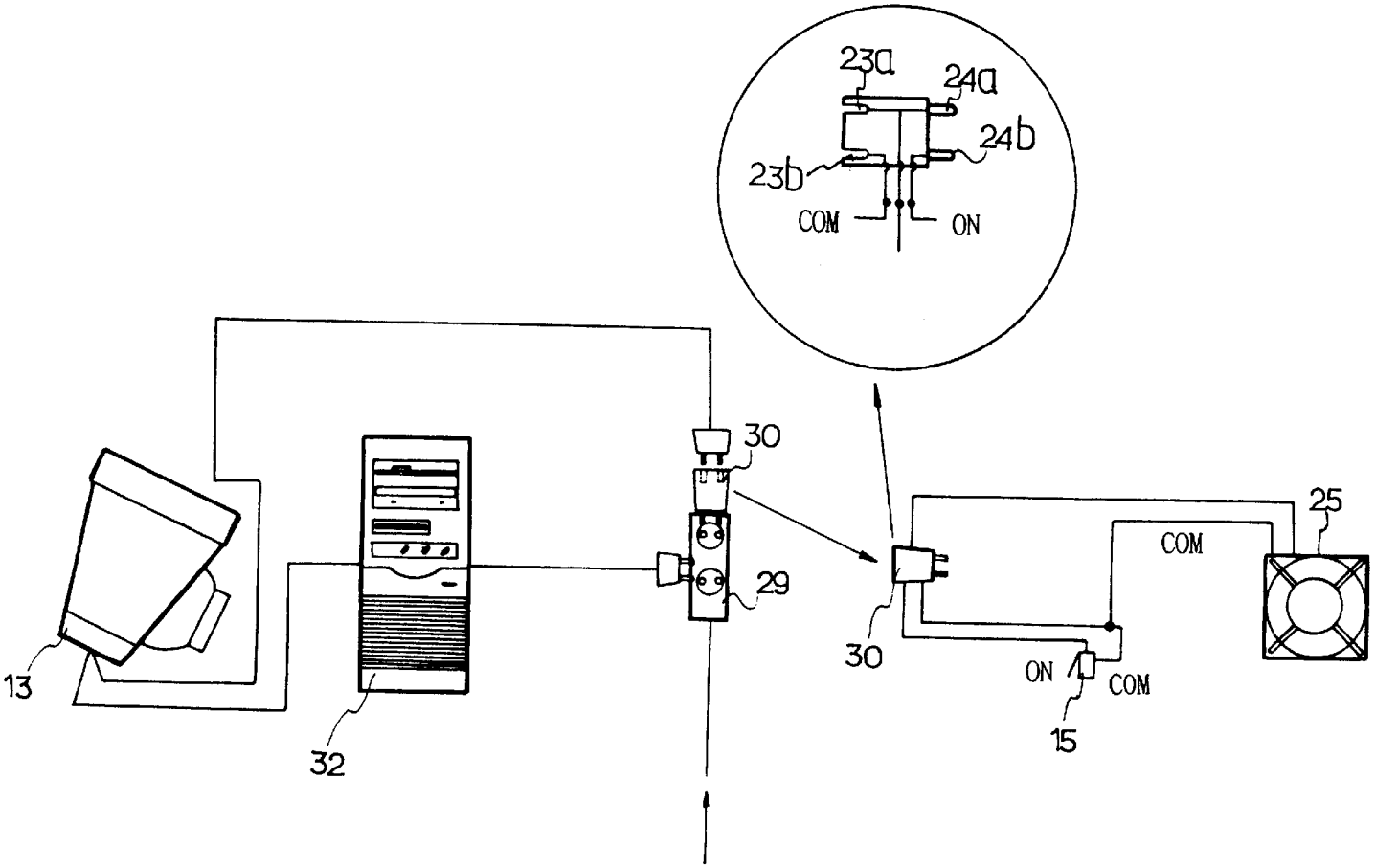
FIG. 7 is a circuit diagram of a power supply of the monitor of the present invention.
Figure 8:
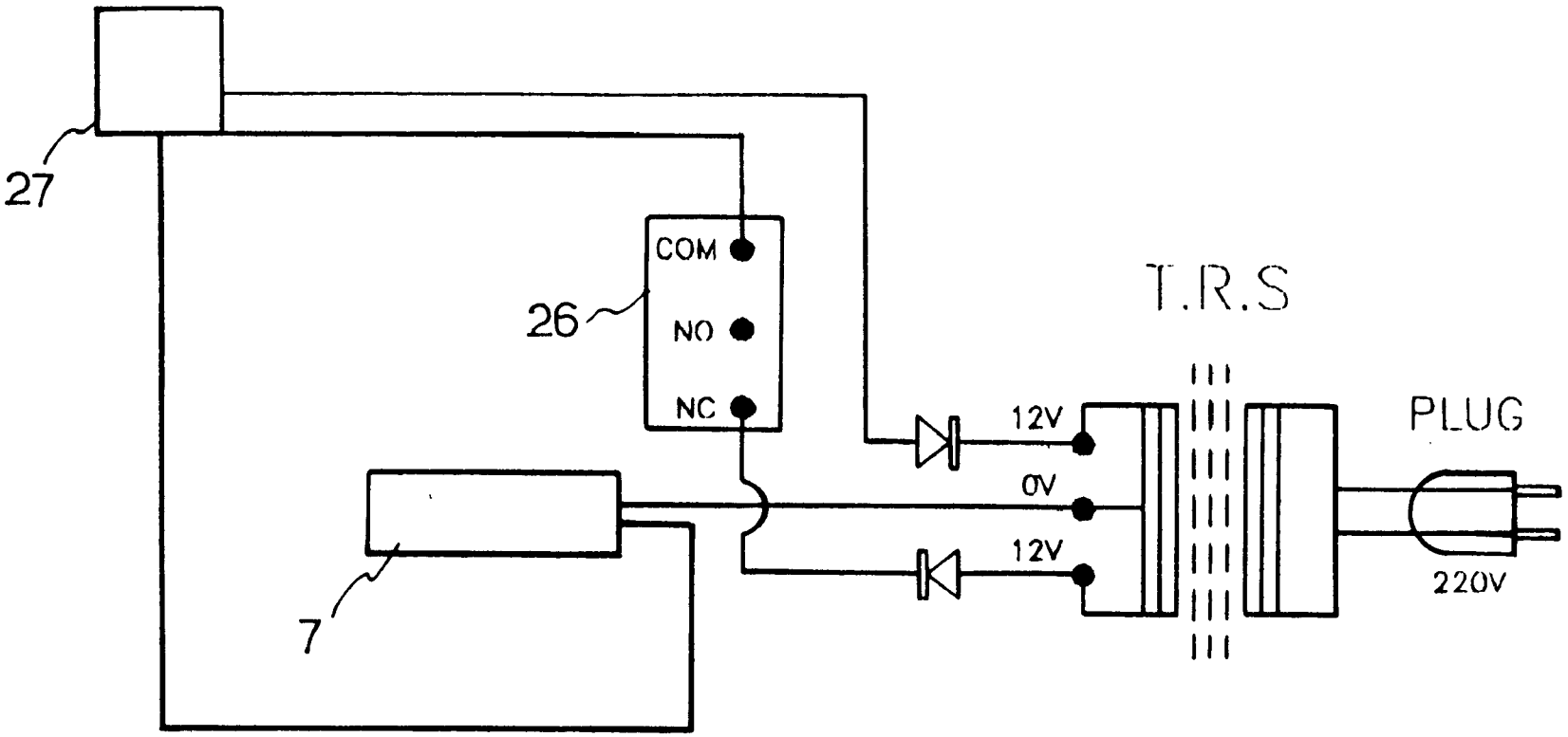
FIG. 8 is a circuit diagram of an operation system to work the monitor of the present invention.

Referring to FIG. 7, an adapter 30 is used to provide electricity to a monitor 13 from a power supply outlet 29 from which electricity flows. A first socket part 23*a* of plural socket parts 23*a* and 23*b* where a plug part 24*a* connecting a power supply to the monitor 13 is inserted, is connected to the plug part 24*a* so that the electricity flowing into the power outlet 29 may be supplied as a positive current to a fan 25. The fan 25 is connected to a motor 7 between a plug part 24*a* and a socket part 23*a*.

A rest plug part 24*b* is connected to a limit switch 15 attached to a side of a keyboard box 17 with a wire.

The limit switch 15 is turned ON by connecting the limit switch 15 to the fan 25 from a second socket part 23*b* and to the wire supplying positive current. The current, which is passed through the fan 25, is transmitted to the monitor 13 along the wire.

If the limit switch 15 is turned OFF, though the current from the power supply outlet 29 passes through the fan 25, the limit switch 15 cuts off the current and therefore, the monitor 13 is not turned on.

The following description provides a modified structure of the adapter 30 that is connected to the power supply outlet 29 which supplies electricity to the monitor 13.

In the structure of the aforesaid adapter 30, the first socket part 23*a* of the plural socket parts 23*a* and 23*b* is connected to the plug part 24*a* of the power supply outlet 29. Accordingly, the flow of power supplied from the outlet 29 is connected to the motor 7 between the plug part 24*a* and the first socket part 23*a,* so that positive current is supplied to the fan 25 installed in the partition 22.

Figure 1:
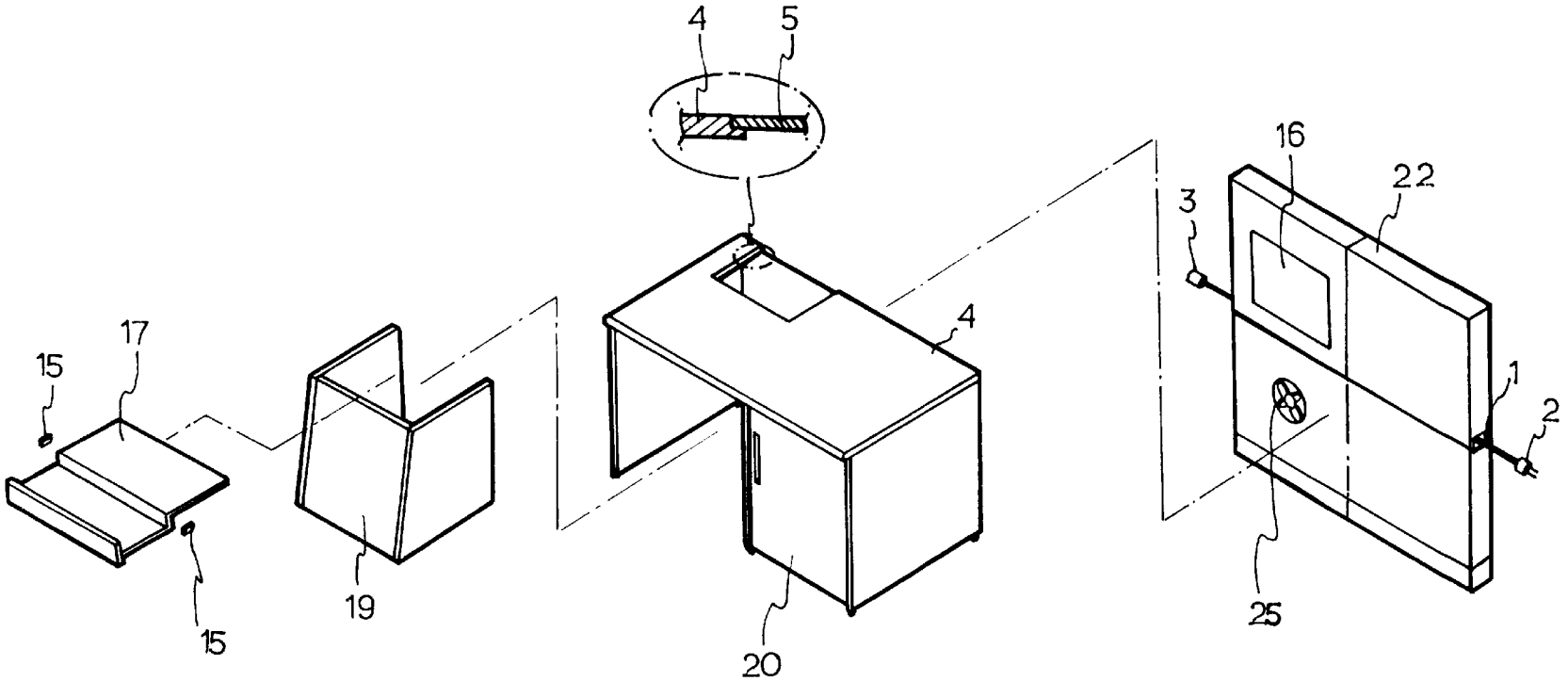
FIG. 1 is an exploded view of the present invention.
Figure 2:
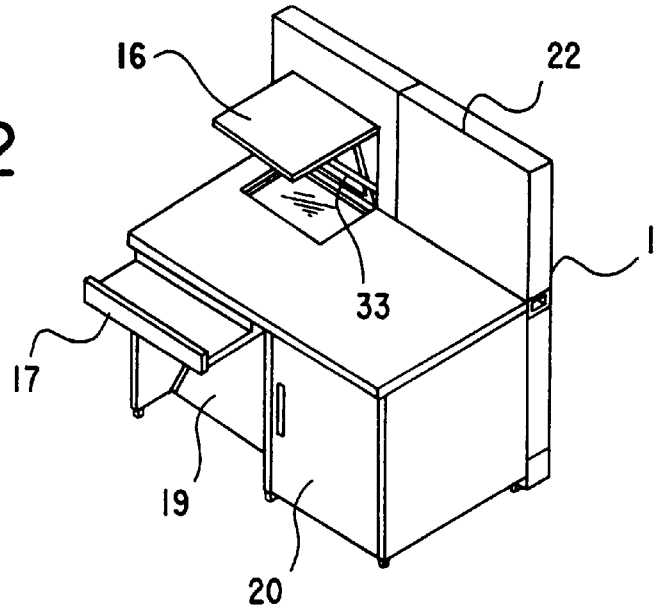
FIG. 2 is a perspective view of the present invention.
Figure 3A:
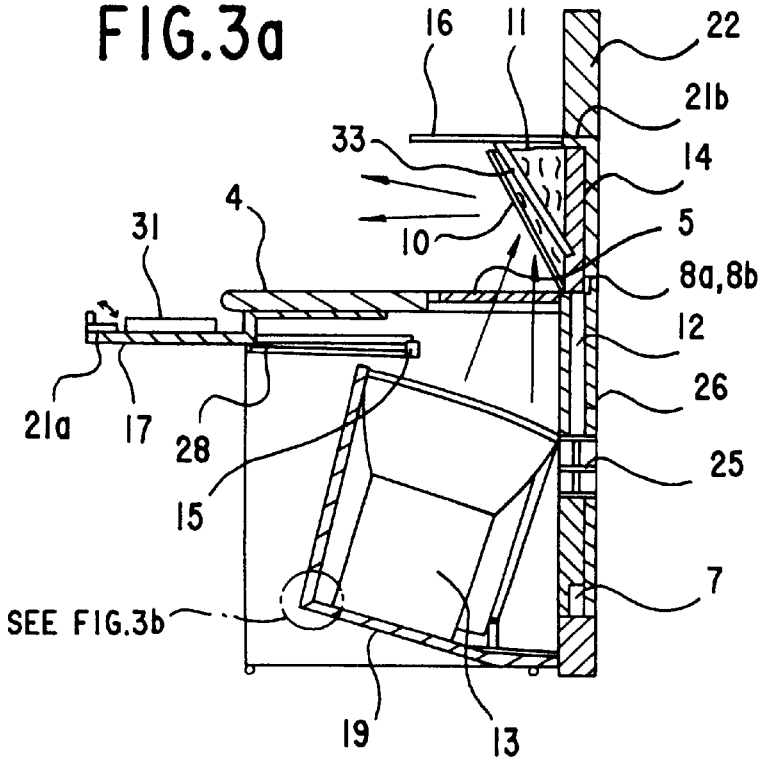
FIG. 3 is a cross-sectional view of the present invention in an operation state.
Figure 3B:
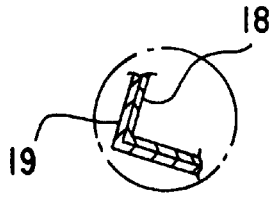
Figure 4:
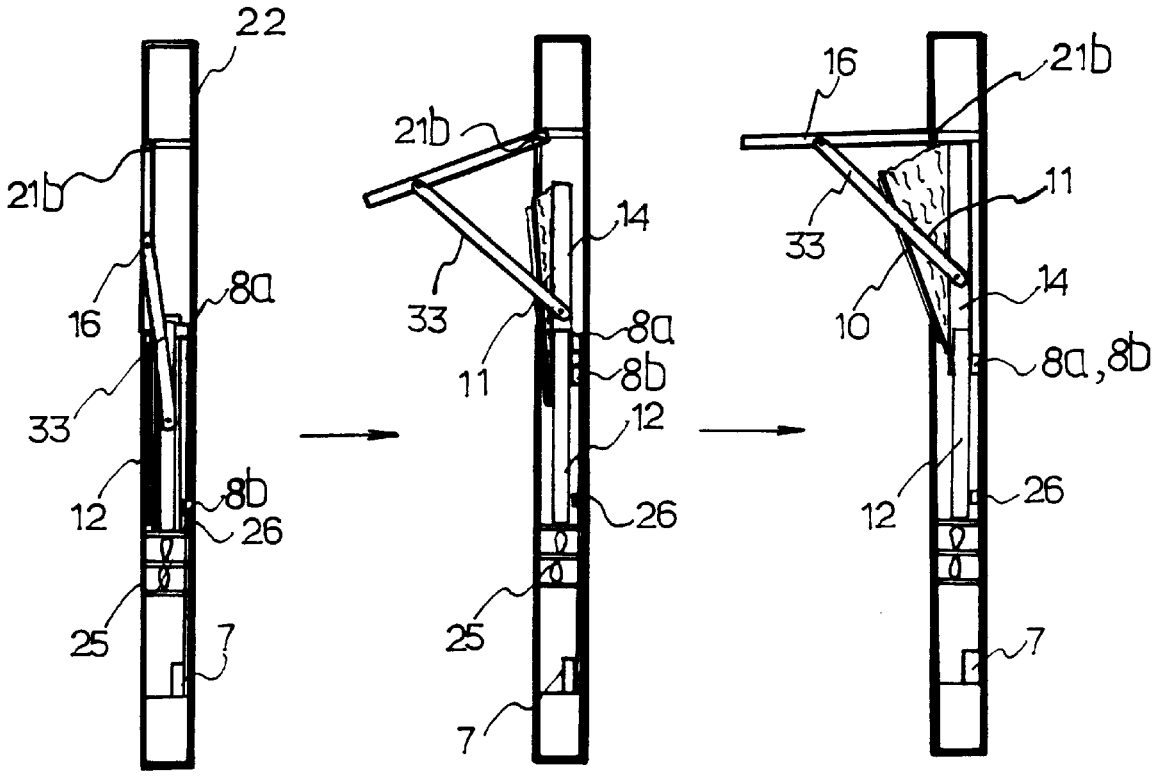
FIG. 4 is a schematic diagram showing the steps of operation of the partition of the present invention.

The rest plug part 24*b* is connected to the limit switch 15 attached to a keyboard rail 28 (FIGS. 3 and 5) which guides the keyboard box 17 so that the keyboard box may easily be drawn and inserted, by the wire.

If the limit switch 15 is turned ON by connecting the wire, which is connected to the fan 25 by the second socket part 23*b* and supplies the positive current to the limit switch 15, the current passing through the fan 25 in the partition 22 is supplied to the monitor 13 along the wire. As such, the current flows to the second socket part 23*b,* thereby turning on the monitor 13.

If the limit switch 15 is turned OFF, even though the current from the power supply outlet 29 passes through the fan 25, the limit switch 15 cuts off the current. Accordingly, the electricity is not transmitted to the monitor 13 and the monitor 13 is not turned on.

When using the computer, if the keyboard box 17, which is provided for setting a keyboard 31 and is attached to the desk, is drawn from the desk 20, the limit switch 15 attached to the keyboard rail 28, which is combined with the keyboard box 17 and guides the keyboard box so that it may easily be drawn and inserted therein, is turned ON so that the current may flow.

That is, if the limit switch 15 is turned ON, the electricity flowing into the power outlet 29 is transmitted from the plug parts 24*a* and 24*b* to the socket parts 23*a* and 23*b* via the fan 25 and the motor 7. The electricity transmitted to the monitor 13 by the socket parts 23*a* and 23*b* turns the monitor 13 ON.

Figure 6:
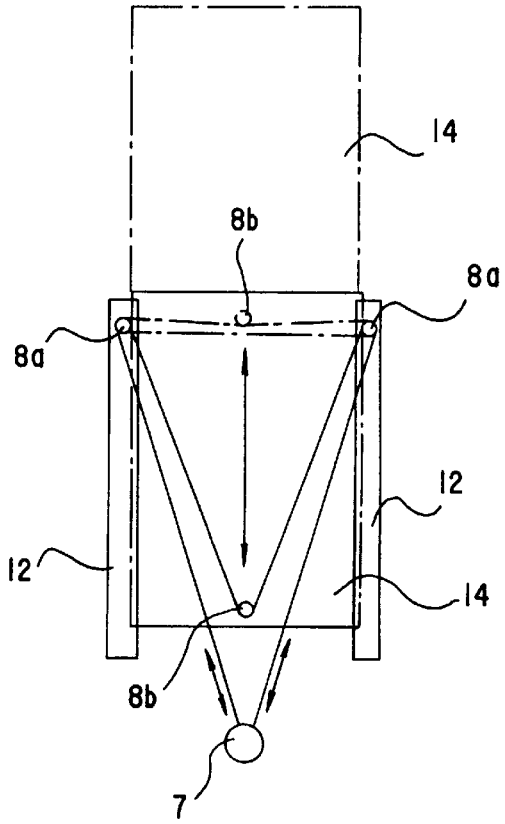
FIG. 6 is a schematic diagram illustrating a theory of operation of a working reflection plate of the present invention.

If the motor 7 is driven, the motor 7 pulls the wire 9 installed inside of the partition 22. As shown in FIG. 6, the wire 9 is supported by rollers 8*a* attached to the right and the left thereof to raise another roller 8*b* to an upper part 4. Accordingly, the reflection plate 14 combined with other roller 8*b,* is guided by reflection plate rails 12 to be drawn from inside of the partition 22 toward the upper part 4.

The reflection plate 14 and a cover 16 are connected by a link 33 to operate. Accordingly, if the reflection plate 14 is raised, the cover 16 opens. On the other hand, if lowered, the cover 16 is closed.

If the reflection plate 14 is drawn completely from inside of the partition 22, a mirror 10 supported by a stopper combined with the reflection plate 14 inclines at a predetermined angle relative to the partition 22.

The screen of the monitor 13 is turned ON by the above-described operation and any image on the monitor is reflected by the mirror 10 attached to the reflection plate 14 by a glass fixed to the stopper formed on the upper plate 4 of the desk 20. Thus, the user sees the reflected screen of the monitor 13, thereby obtaining the same effect as if the monitor 13 were provided on the desk 20 in front of the user.

In case the user has to stop working with the computer for some time and the user inserts the keyboard box 17 into the desk 20, the limit switch 15 attached to the keyboard rail 28 is turned OFF whereby, the wire 9 becomes unraveled as the motor 7 inversely rotates. As such, wire 9 cannot support the roller 8*b* and the reflection plate 14 guided by the reflection rails 12 is inserted into the partition 22.

If the reflection plate 14 is lowered into the partition 22, the cover 16 connected by the link 33 is combined with the partition 22 body in a circle. If the reflection plate 14 is completely lowered, the cover 16 is completely combined with the partition 22 to be supported by the link 33.

Further, as the limit switch 15 is turned OFF, the operation of the fan 25 attached to the lower center part of the partition 22 is stopped. Also, the electricity is no longer supplied to the monitor 13, so any harmful electromagnetic waves are not generated by the monitor 13.

In the aforesaid state, the power supply of the monitor 13 is merely cut off but the computer 32 continues to operate.

In case the user wants to resume working with the computer 32, the user can draw the keyboard box 17 from the desk 20, whereby the screen of the monitor 13 and the fan 25 are turned ON as the limit switch 15 is turned ON, so that the fan 25 can help the electromagnetic cut off film 18 discharge the harmful electromagnetic waves generated by the monitor 13 to the outside of a monitor box 19. And, when the reflection plate 14 is again drawn from inside of the partition 22 along the reflection rails 12 through the operation of the motor 7, wire 9 and rollers 8*a* and 8*b*, the user can see the screen in the state when the user stopped working with the computer 32.

Furthermore, the motor 7, which is manipulated right and left and moves the reflection plate 14 up and down, and a switch 27, which is connected to a motor limit switch 26, are installed in the front side of the desk 20 so that when the keyboard box 17 is drawn from inside of the partition 22, the user may adjust the height of the reflection plate 14 to his eye level by manipulating the switch 27 left to control the operation of the motor 7.

In course of the reflection plate 14 being inserted into the partition 22, if the wire 9 which moves the reflection plate 14 up and down along the reflection rails 12 is completely winded by the motor 7, the motor 7 inversely rotates thereby, automatically drawing the reflection plate 14 from the partition 22. Accordingly, if the switch 27 is manipulated right to turn off the motor limit switch 26 to stop operation of the motor 7 so the reflection plate 14 may not be drawn along the reflection plate rails 12, the state the reflection plate 14 is inserted into the partition 22 is maintained.

The motor limit switch 26 temporarily stops the operation of the motor 7. Therefore, if the keyboard box 17 is drawn from the desk 20, the temporary state is dissolved and operation of the motor 7 is not interrupted.

Further, a hinge 21 a attached to the front side of the keyboard box 17 so that the front part of the keyboard box 17 may be folded to remove any inconvenience the user may have in using the keyboard 31.

Also, a wire cap I is installed in the center of a side portion of the partition 22, and a positive plug 2 and a negative plug 3 are respectively installed in the right side and the left side of the wire cap 1. Accordingly, upon a mutual connection of several like partitions 22, the current can be transmitted to the inside of the partition 22 by connecting the mutual positive and negative plugs 2 and 3 in series.

After finishing work with the computer, the user can insert the keyboard box 17 into the desk 20, thereby turning the limit switch 15 OFF, which inversely rotates the motor 7 so that the wire 9 is unraveled. Thus, the reflection plate 14 is lowered along the reflection plate rails 12, and the glass 5 fixed to the stopper compresses a ledger 11 so that the reflection plate 14 may have a predetermined volume, thereby being inserted into the partition 22.

Further, the cover 16, which is fixed to the reflection plate 14 by another hinge 21*b*, cuts off a direct ray of light to be projected, thereby performing a function of preventing the user from being dazed by light.

The positive plug 2 and negative plug 3 are respectively installed to the right side and the left side of the wire cap 1 wherein several partitions 22 are mutually connected by the wire cap 1 to prevent the wire 9 from protruding to the outside, and accordingly, the partition 22 has a pleasant appearance.

The harmful electromagnetic waves that are emitted by the monitor 13 are forcibly discharged by an electromagnetic wave cutoff film 18 attached to one side of the partition 22 within the monitor box 19 and the fan 25 to protect the user.

Figure 5A:
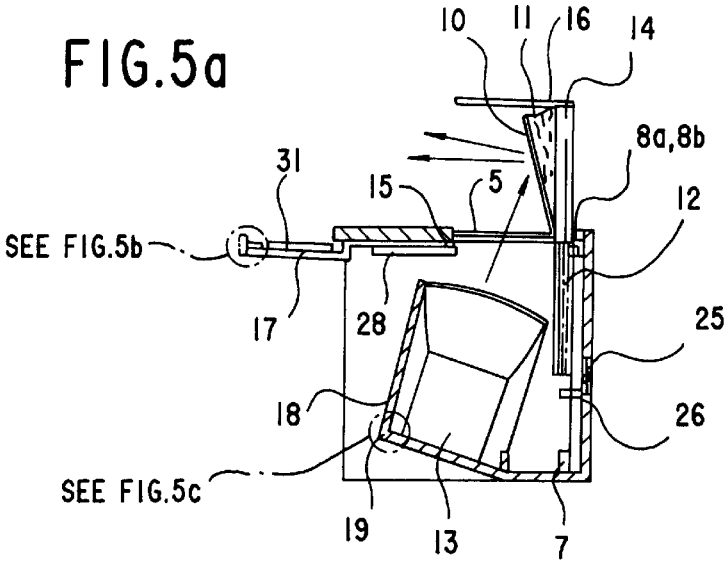
FIG. 5 is a partial cross-sectional view of the present invention.
Figure 5B:
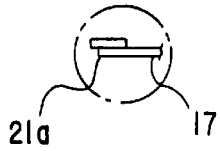
Figure 5C:
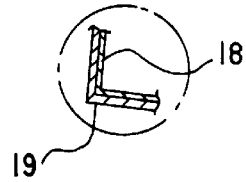

In the above-mentioned structure of the reflection plate 14, the reflection plate 14 is installed inside of the desk, not to the partition 22, as shown in FIG. 5, and can be used even when there is only the desk 20 without the partition 22. Furthermore, the above reflection plate 14 operates through the same theory as the reflection plate 14 installed to the inside of the partition 22.

It will be apparent to those skilled in the art that various modifications and variations can be made in a partition combined into a computer desk to display a screen of a monitor of the present invention without departing from the spirit or scope of the invention. Thus, it is intended that the present invention cover the modifications and variations of this invention provided they come within the scope of the appended claims and their equivalents.

What is claimed is:

1. An assembly combining a partition with a computer desk having a monitor to display a screen of the monitor positioned beneath an upper plate of the computer desk to a user, the assembly comprising:

a fan positioned in the partition below the upper plate of the computer desk;

a motor positioned in the partition below the fan;

an adapter that provides electricity to the monitor from a power supply outlet, the adapter has a first socket part and a second socket part;

a first plug part connects the power supply outlet to the monitor, the first plug part is connected with the first socket part to provide electricity to the fan, wherein the fan is connected to the motor between the first socket and plug parts;

a keyboard box slidable along a bottom face of the upper plate of the computer desk, the keyboard box having at least one limit switch attached to a side of the keyboard box; and a wire connects the limit switch and the second socket part to the fan, wherein when the limit switch is turned ON, electricity is transmitted through the fan to the monitor along the wire to turn the monitor ON.

2. The assembly according to claim 1, wherein when the limit switch is turned OFF, electricity is transmitted only to the fan and not the monitor.

3. The assembly according to 2, further comprising:

keyboard rails to guide the keyboard box along the bottom face of the upper plate of the computer desk so that the keyboard box may be drawn from and returned to an unused position beneath the upper plate, wherein the limit switch is connected to the keyboard rails.

4. The assembly according to claim 3, wherein the limit switch is turned ON by drawing the keyboard box from underneath the upper plate of the computer desk along the keyboard rails, thereby transmitting electricity to the monitor along the wire to turn the monitor ON.

5. The assembly according to claim 4, further comprising:

a cable that is pulled by the motor when the motor is driven;

a plurality of support rollers that support the cable;

a reflection plate roller;

a pair of reflection plate rails located within the partition and parallel to a longitudinal axis of the partition; and a reflection plate guidable along the reflection plate rails, wherein the reflection plate is raised with the reflection plate roller toward an upper limit of the partition by the cable supported by the support rollers when the motor is driven.

6. The assembly according to claim 5, wherein a cover in the partition opens when the reflection plate is raised and a mirror inclines at a predetermined angle relative to the upper plate of the computer desk so that the mirror is between the reflection plate and the user.

7. The assembly according to claim 6, further comprising a link that maintains the cover in an open position, wherein one end of the link is attached to the cover and the other end of the link is attached to the partition.

8. The assembly according to claim 6, further comprising glass fixed to the upper plate, wherein the user sees an image from the monitor screen passing through the glass and reflected by the reflection plate.

9. The assembly according to claim 8, wherein a reflection plate motor controls the extent to which the reflection plate is raised or lowered by the cable so that the use can adjust the reflected image from the monitor screen.

10. The assembly according to claim 1, further comprising:

a wire cap positioned in a center portion of the partition;

a positive plug on a first end of the wire cap; and a negative plug on a second end of the wire cap, wherein a plurality of like assemblies can be interconnected such that the electricity can be transmitted through multiple assemblies.

* * * * *